United States Patent [19]

Duncan

[11] Patent Number: 4,508,482

[45] Date of Patent: Apr. 2, 1985

[54] METHOD AND APPARATUS FOR HARVESTING TOBACCO

[75] Inventor: George A. Duncan, Lexington, Ky.

[73] Assignee: University of Kentucky Research Foundation, Lexington, Ky.

[21] Appl. No.: 469,704

[22] Filed: Feb. 25, 1983

[51] Int. Cl.[3] ..... A24B 1/08

[52] U.S. Cl. ..... 414/26; 182/147; 187/27; 294/5.5; 294/81.1; 414/786

[58] Field of Search ..... 414/26, 786; 294/5.5, 294/81 R; 254/264; 187/20, 27; 182/142, 147

[56] References Cited

U.S. PATENT DOCUMENTS

| | | | |
|---|---|---|---|
| 965,055 | 7/1910 | Wells | 294/5.5 |
| 1,852,524 | 4/1932 | Jones | 182/147 |
| 1,919,107 | 7/1933 | Harris | 414/26 X |
| 2,808,283 | 10/1957 | Vickers | 414/26 X |
| 3,251,435 | 5/1966 | Fisher | 182/142 |
| 3,497,253 | 2/1970 | Gentry | 414/26 X |
| 4,067,454 | 1/1978 | Helbling | 414/26 |

*Primary Examiner*—Leslie J. Paperner

*Attorney, Agent, or Firm*—Frank C. Leach, Jr.

[57] ABSTRACT

A support beam is formed of two wooden members held in spaced relation to each other by spaced blocks to provide openings to receive tobacco sticks with tobacco stalks thereon. Each end of the support beam has a longitudinal slot extending therethrough to enable a cable, which is attached to a rafter in the upper end of the barn, to extend therethrough. The lower end of each cable has a loop for attachment to a drum of a hoist mechanism, which has a portion bearing against the bottom surface of the support beam. The support beam has a depending projection spaced inwardly from each end to limit the outward movement of each of the hoist mechanisms. The drum of each of the hoist mechanisms is rotated separately to enable the support beam to be raised upwardly into the barn at an angle to clear rail supports on which the support beam is supported. The support beam may be removed from the barn rail supports by the drums of the two hoist mechanisms again being connected to the looped ends of the cables and engaging the bottom surface of the support beam to lift it from the barn rail supports and then tilt it prior to lowering it to the ground.

6 Claims, 11 Drawing Figures

METHOD AND APPARATUS FOR HARVESTING TOBACCO

This invention relates to a method and apparatus for harvesting tobacco and, more particularly, to a method and apparatus for disposing tobacco for support in a barn for curing and removing it therefrom after curing.

In producing stalk-harvested burley tobacco, the placing of sticks of tobacco on rail supports within an air-cure barn for curing of the plants of tobacco thereon requires a large amount of labor and a relatively large period of time. Removal of the sticks of tobacco after the plants of tobacco on the sticks have been cured also requires a large amount of labor and a relatively large period of time.

Each stick of tobacco usually contains six plants with the weight of the tobacco varying from twenty-two to thirty-five pounds. The barn is filled from the top downwardly so that a number of workers must stand on various rail supports to lift the relatively heavy tobacco sticks to the uppermost part of the barn. Thus, some of the workers must work at a height as high as twenty-nine to thirty feet above the ground with four to six workers being required from the ground to the top.

This presents a danger to a worker because of the substantial distance that one can fall. Since a fall of this distance can be fatal, this is very dangerous work. Additionally, it is very strenuous work so that the lifter also can be injured from lifting the sticks of tobacco.

It also is desired to be able to harvest the cut tobacco in a timely manner. In order for the tobacco to lose some moisture so as to be of lighter weight and to initiate good curing of the tobacco, the cut tobacco is normally left exposed in the fields during favorable weather from two to three days. However, a sudden rain can cause mud and moisture damage to the cut tobacco to reduce its quality and market value.

Accordingly, if the danger of rain exists, it is necessary to house the tobacco within the barn as quickly as possible. This avoids possible reduction in quality and market value of the tobacco.

Therefore, it is desired to be able to house cut tobacco as quickly as possible and as safely as possible. It also is desired to be able to reduce the labor involved in housing the tobacco to reduce the cost to the producer and the need to find seasonal workers on relatively short notice such as when the danger of rain exists, for example.

Various apparatuses for housing tobacco have previously been suggested. One has used portable curing frames for handling and housing tobacco with a modified farm tractor loader. The frames were stacked two to three high in a modified open-interior, air-cure barn. While this arrangement saved approximately forty per cent of the field loading, transport, and housing labor, it reduced the capacity of the barn, caused substantial changes in the barn, and had substantial cost of equipment additions and barn changes.

In U.S. Pat. No. 3,497,253 to Gentry, Jr., tobacco sticks, which have the tobacco stalks thereon, were disposed on a rack and the rack transported to a barn. The rack was then raised by a fork lift so that latches on opposite ends of the rack were supported on rail supports within the barn and on which the tobacco sticks had previously been supported directly by manual labor.

The apparatus of the aforesaid Gentry, Jr. patent requires skillful manipulation by a fork lift operator to remove the rack from the rail supports of the barn. This is because the latches overlie the rail supports in the barn and must be raised and tilted to be removed therefrom. Thus, the apparatus of the aforesaid Gentry, Jr. patent required modification of the barn and a fork lift. Therefore, while the apparatus of the aforesaid Gentry, Jr. patent reduced the required manual labor, it added other substantial expenses thereto.

Another apparatus for housing tobacco is disclosed in U.S. Pat. No. 4,067,454 to Helbling. The apparatus of the aforesaid Helbling patent required the removal of rail supports within the barn. These rail supports could be shortened and have holes drilled therein to receive the tobacco sticks.

Each modified rail support had a pair of short ropes attached to two corresponding cables supported in the barn. The cables extended to the top of the barn and through pulleys down to a post where each was connected to a separate winch. Each of the additional rail supports was attached to the rail support above it so that four or five rail supports could be hoisted vertically in a continuous linkage. When a tier of the barn was filled, the two winches were locked and the tobacco rail supports remained in this hanging position on the two cables to enable curing of the tobacco supported on the sticks disposed in the holes in each of the rail supports. The cured tobacco was lowered to the ground in the opposite manner to that in which it was raised in the barn.

While the apparatus of the aforesaid Helbling patent eliminated the strenuous labor and the number of workers required, it required substantial modification of the barn. It also required winches to be located on the support posts.

There are a number of criteria required for a tobacco harvesting apparatus to be satisfactory. One is the use of a conventional barn with a minimum modification because the investment in a barn is substantial, and these are already in existence. Any modifications in the barn must not cause structural weakness thereof, and these modifications must be simple and economical.

Other criteria are that there be no workers working on the rail supports of the barn above the ground and that only one or two workers be required. This decreases the injury factor and reduces the peak crew size and the labor costs of conventional methods.

A further criterion is that the barn not be cluttered during the remainder of the year in which the tobacco is not stored within the barn. Since the tobacco occupies the barn for only three to four months during a year, the owner of the barn may wish to use the barn for other storage, work, or livestock usages, for example. Therefore, a barn full of tobacco frames or special apparatuses such as the racks of the aforesaid Gentry, Jr. patent, for example, would not be satisfactory.

Any apparatus for harvesting tobacco must be capable of being used by most producers and have a reasonable cost. Without reasonable cost, the user will not invest the money to save the labor cost and decrease the danger to the workers.

The method and apparatus of the present invention meets these criteria. The only modifications of the barn are to attach cables to suitable means in the upper portion of the barn such as steel pipes supported by rafters in the barn, for example, removal of the tier rails, and to add blocks and gusset boards to the rail supports in the barn to provide support for the support beams on which the tobacco sticks are supported.

Accordingly, there is no effect on the structural soundness of the barn when modifying it for use with the apparatus of the present invention. This modification also is relatively low cost and does not have any effect on the storage area in the barn.

The present invention also requires a specific support beam for the tobacco sticks. This support beam must be capable of receiving the cables supported from the steel pipes. Thus, this is a further cost.

The only other cost of the present invention is the use of two portable hoist mechanisms. These two portable hoist mechanisms may be used with the cables throughout the barn and may be operated by one person.

The support beam of the apparatus of the present invention is preferably formed of two substantially parallel wooden members having spacer blocks therebetween throughout their lengths with the spaces therebetween receiving the tobacco sticks. These spacer blocks are attached to the wooden members by bolts and nuts.

The cables are preferably suspended from steel pipes with each of the pipes being attached to at least three rafters in the barn. More than one of the cables can be suspended from the same pipe.

Each of the support beams also has a projection at each of its ends to overlie one of the gusset boards and rest on the rail support or the block attached to the support beam. This prevents any inadvertent displacement of the support beam from the rail support or block attached thereto on which it is supported.

Each of the support beams also has a projection spaced inwardly from each of its ends to control the maximum outward position of each of the portable hoist mechanisms when the portable hoist mechanism is engaging the bottom of the support beam. That is, these projections insure that the portable hoist mechanisms remain engaged with the desired areas of the bottom of the support beam for connection to the two cables extending through the support beam.

An object of this invention is to provide a method and apparatus for harvesting tobacco.

Another object of this invention is to provide a method and apparatus for housing tobacco in a barn with only one person being required to house the tobacco in the barn if desired.

A further object of this invention is to provide a hoist for raising tobacco into a barn for curing and lowering tobacco from the barn after it has been cured.

Other objects of this invention will be readily perceived from the following description, claims, and drawings.

This invention relates to an apparatus for harvesting tobacco including a support beam having means to receive tobacco sticks therein for support by the support beam. Each end of the support beam has enabling means to enable a cable extending downwardly from a barn support to pass therethrough. The apparatus also includes separate hoist means for attachment to the lower end of each of the two cables passing through the enabling means in the support beam and engaging the bottom surface of the support beam to raise or lower the support beam along the cables passing through the enabling means. The support beam has means adjacent each end to limit outward movement of each of the hoist means.

This invention further relates to a hoist for use in raising and lowering a support beam having tobacco sticks supported thereby with the tobacco sticks having tobacco thereon. The hoist includes frame means supporting a drum having attachment means for attachment to the lower end of a cable attached in the upper end of a barn and passing through the support beam. The frame means has means for engaging the support beam to raise and lower the support beam after the attachment means is attached to the cable passing through the support beam. The frame means supports rotating means, which rotates the drum in either direction. The frame means has its bottom end formed at an angle to clear any rail support during raising and lowering of the support beam.

This invention still further relates to a method of harvesting tobacco including disposing sticks of tobacco on a support beam, passing a first cable supported at its upper end in the upper portion of a barn through a longitudinal slot in one end of the support beam and a second cable supported at its upper end in the upper portion of a barn through a longitudinal slot in the other end of the support beam, and attaching the lower end of the first cable to a first rotary drum and the lower end of the second cable to a second rotary drum. The first rotary drum and the second rotary drum are rotated until a support for the first rotary drum engages the bottom of the support beam and a support for the second rotary drum engages the bottom of the support beam. The first rotary drum and the second rotary drum are selectively rotated to tilt one end of the support beam relative to its other end to enable the support beam to pass between barn supports on which the support beam is to rest. After the support beam is above the barn supports on which the support beam is to rest, the direction of rotation of each of the first rotary drum and the second rotary drum is changed. The first rotary drum and the second rotary drum are selectively rotated to dispose the support beam on the barn supports on which the support beam is to rest.

The attached drawings illustrate a preferred embodiment of the invention, in which.

Figure 1:
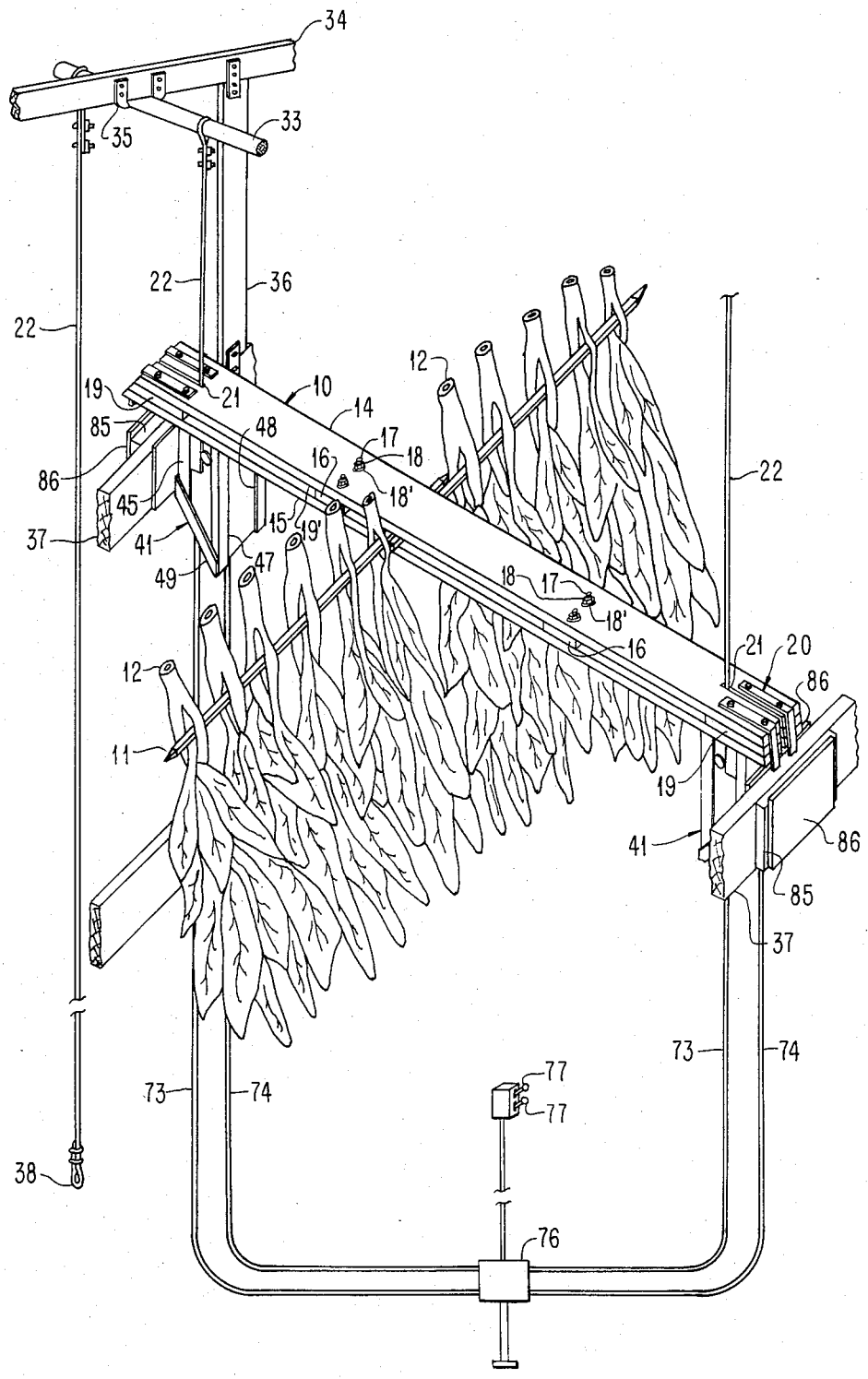
FIG. 1 is a fragmentary perspective view of a portion of a tobacco barn having a support beam of the apparatus of the present invention.

Referring to the drawings and particularly FIG. 1, there is shown a support beam 10 for supporting a plurality of tobacco sticks 11 (two shown). Each of the tobacco sticks 11 has a plurality of tobacco stalks 12 supported thereon in the well-known manner.

The support beam 10 includes an upper wooden member 14 and a lower wooden member 15. The wooden members 14 and 15 are disposed in substantially parallel and spaced relation to each other by a plurality of spacer blocks 16, which are slightly larger than the tobacco sticks 11. For example, the spacer blocks 14 can have a thickness of $1\frac{1}{4}''$ when the major dimension of the tobacco stick 11 is 1".

The spacer blocks 16 have bolts 17 extending through openings therein and similar aligned openings in the wooden members 14 and 15. Nuts 18 retain the bolts 17 in position. Flat washers 18' are employed between the wooden members 14 and 15 and the nuts 18 and the heads of the bolts 17.

Each end of the support beam 10 has a support block 19 disposed between the members 14 and 15 to also aid in spacing the members 14 and 15 from each other. Thus, elongated openings 19' are provided in the support beam 10 for the tobacco sticks 11 to be received in alternating sequence. The tobacco sticks 11 normally extend through the openings 19'.

Figure 7:
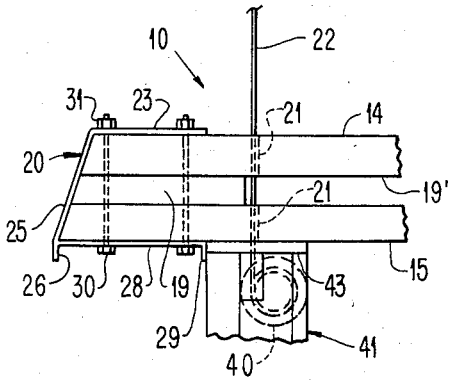
FIG. 7 is a fragmentary elevational view of a portion of a support beam with the portable hoist disposed in position for cooperation therewith.
Figure 2:
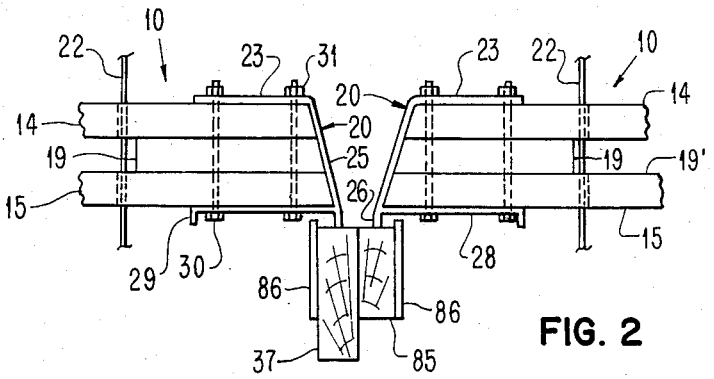
FIG. 2 is a fragmentary elevational view, partly in section, showing two of the support beams of FIG. 1 supported on a rail support of the barn.

As shown in FIGS. 2 and 7, each end of the support beam 10 is cut at an angle to the vertical with this angle preferably being 15°–20°. Accordingly, each end of the lower wooden member 15 extends further than each corresponding end of the upper wooden member 14.

Figure 8:
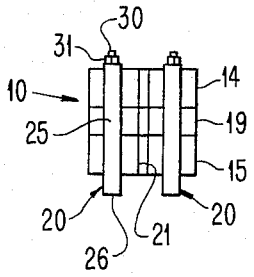
FIG. 8 is an end elevational view of one end of a support beam.

A pair of steel straps 20 is attached to each end of the support beam 10. The steel straps 20 are disposed on opposite sides of a longitudinal slot 21 (see FIG. 8) in the support beam 10. The longitudinal slot 21 extends completely through the support block 19 to divide the support block 19 into two parts. The longitudinal slots 21 enable a cable 22 (see FIG. 7) to be received in each end of the support beam 10. For example, the cable 22 can have a diameter of 3/16" and the slot 21 can have a width of $\frac{1}{4}''$ to 5/16".

Each of the steel straps 20 includes an upper horizontal portion 23 extending over the top of the upper wooden member 14 and an angle portion 25, which extends downwardly from the upper portion 23. The angle portion 25 bears against the ends of the upper wooden member 14, the support block 19, and the lower wooden member 15. The lower end of the angle portion 25 has a projecting portion 26 extending substantially vertically.

Each of the straps 20 has a lower horizontal portion 28 extending from the angle portion 25 and substantially parallel to the upper portion 23 of the strap 20. The lower portion 28 has a projecting portion 29 at its inner end. The lower portion 28 of the strap 20 bears against the lower surface of the lower wooden member 15.

Bolts 30 extend through aligned openings in the lower portion 28 of the strap 20, the lower wooden member 15, the support block 19, the upper wooden member 14, and the upper portion 23 of the strap 20. Nuts 31 cooperate with the bolts 30 to secure each of the straps 20 to the support beam 10.

As shown in FIG. 1, the upper end of each of the cables 22 is secured to one of a plurality of substantially horizontal steel pipes 33. Each of the steel pipes 33 is secured to a plurality of rafters 34 in the barn by nailed strap hangers 35 with each of the steel pipes 33 being secured to at least three of the rafters 34.

The rafters 34 also may have braces 36 to aid in supporting the rafters 34. Each of the braces 36 extends upwardly from one of a plurality of rail supports 37.

Each of the cables 22 is preferably formed of galvanized steel. Each of the cables 22 has a sufficient length to hang within two feet of the ground. Each of the cables 22 has a breaking strength of at least 3,000 pounds.

The lower end of each of the cables 22 has a loop 38 for attachment to a hook 39 (see FIGS. 4 and 6) of a rotatable drum 40 of a portable hoist 41. The hoist 41 includes a frame 42, which is preferably aluminum, having a top plate 43 with an opening 44 therein through which the cable 22 (see FIG. 1) passes for attachment to the hook 39 (see FIGS. 4 and 6) on the drum 40 of the hoist 41. While the opening 44 is shown as circular, it should be understood that it may have an oval shape or any other suitable shape.

Figure 3:
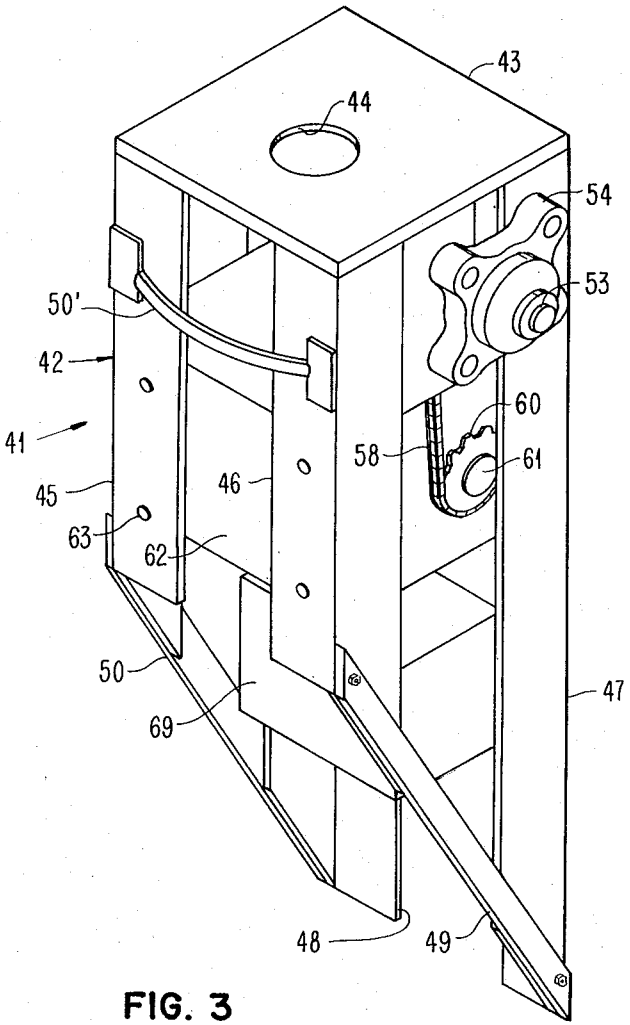
FIG. 3 is a perspective view of a portable hoist of the apparatus of the present invention.
Figure 6:
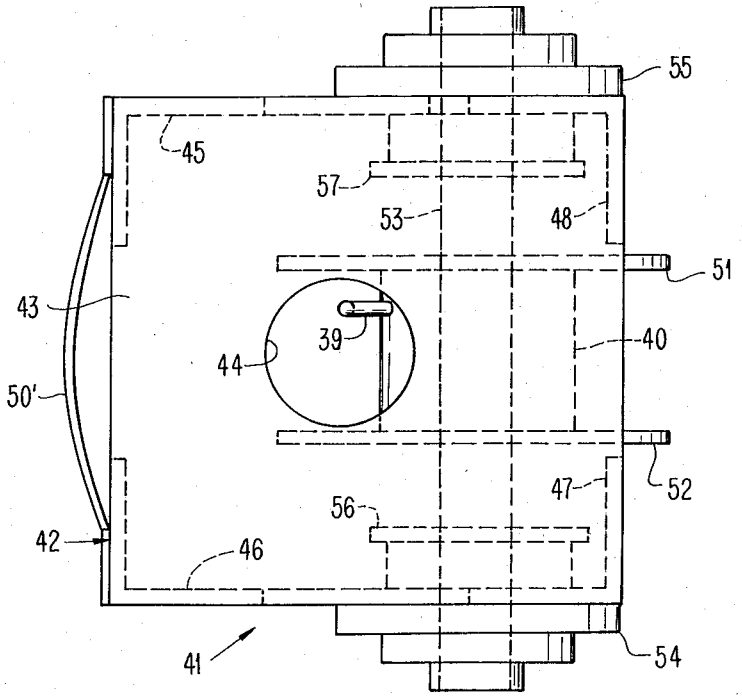
FIG. 6 is a top plan view of the portable hoist of FIG. 3.
Figure 4:
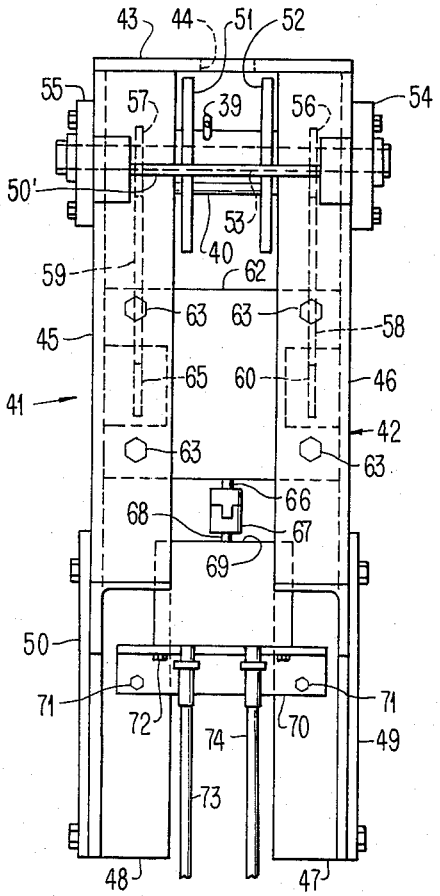
FIG. 4 is a front elevational view of the portable hoist of FIG. 3.

As shown in FIG. 6, the frame 42 includes four angle elements 45, 46, 47, and 48, which are secured to the lower surface of the top plate 43 by suitable means such as welding, for example, and extend downwardly therefrom to form legs of the frame 42. As shown in FIGS. 3 and 4, the angle elements 45 and 46 are shorter than the angle elements 47 and 48. A brace 49 extends between the bottom ends of the angle elements 46 and 47, and a brace 50 extends between the bottom ends of the angle elements 45 and 48. The angle of each of the braces 49 and 50 is the same and prevents catching of the hoist 41 on any of the rail supports 37 (see FIG. 1) during vertical movement of the hoist 41 in either direction through positioning the shorter angle elements 45 (see FIG. 3) and 46 on the outer side.

The frame 42 has a handle 50' attached to the angle elements 45 and 46. The handle 50' facilitates lifting of the hoist 41, carrying the hoist 41, guiding the hoist 41 to the position of FIG. 7 after the cable 22 is attached to the drum 40, and insuring that the hoist 41 is positioned with the shorter angle elements 45 (see FIG. 3) and 46 on the outer side.

As shown in FIG. 4, the drum 40 has a pair of side walls or plates 51 and 52 at its ends to maintain the cable 22 (see FIG. 1) wrapped around the drum 40 (see FIG. 4). The drum 40 is mounted on a shaft 53, which has its ends rotatably supported in a bearing housing 54 and a bearing housing 55. The bearing housing 54 is attached to the angle elements 46 and 47 of the frame 42 while the bearing housing 55 is secured to the angle elements 45 and 48 of the frame 42.

The shaft 53 has a pair of chain sprockets 56 and 57 attached thereto. The sprocket 56 meshes with a chain 58 while the sprocket 57 meshes with a chain 59. The chain 58 also passes around a sprocket 60 (see FIG. 3) on one end of an output shaft 61 of a gear-reduction box 62, which preferably has a 60 to 1 worm gear reduction ratio. The gear-reduction box 62 is supported on the frame 42 by bolts 63 attaching the gear-reduction box 62 to each of the angle elements 45–48.

The gear-reduction box 62 has the other end of the output shaft 61 extending from its opposite side. The other end of the output shaft 61 has a chain sprocket 65 (see FIG. 5) mounted thereon for meshing with the chain 59. Accordingly, the rotation of the output shaft 61 of the gear-reduction box 62 causes rotation of the drum 40 (see FIG. 4).

Figure 5:
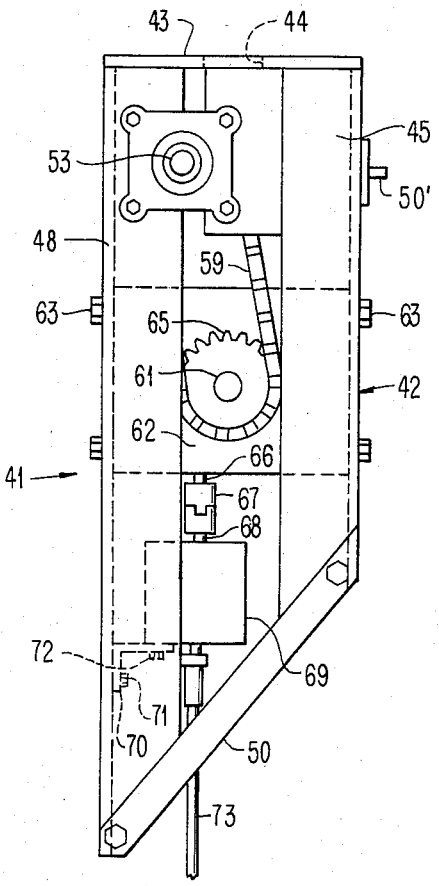
FIG. 5 is a side elevational view of the portable hoist of FIG. 3.

The gear-reduction box 62 has its input shaft 66 connected through a coupling 67 to an output shaft 68 of a hydraulic motor 69, which is supported on the frame 42 through an L-shaped bracket 70 (see FIG. 5). The bracket 70 is attached by bolts 71 to the angle elements 47 (see FIG. 4) and 48. The upper portion of the bracket 71 is disposed beneath the hydraulic motor 69 and has the hydraulic motor 69 attached thereto by bolts 72 extending through the bracket 70 and into mounting holes in the bottom of the hydraulic motor 69. One suitable example of the hydraulic motor 69 is sold by Delta Power Hydraulic Company, Rockford, Illinois as model DM-6.

Figure 11:
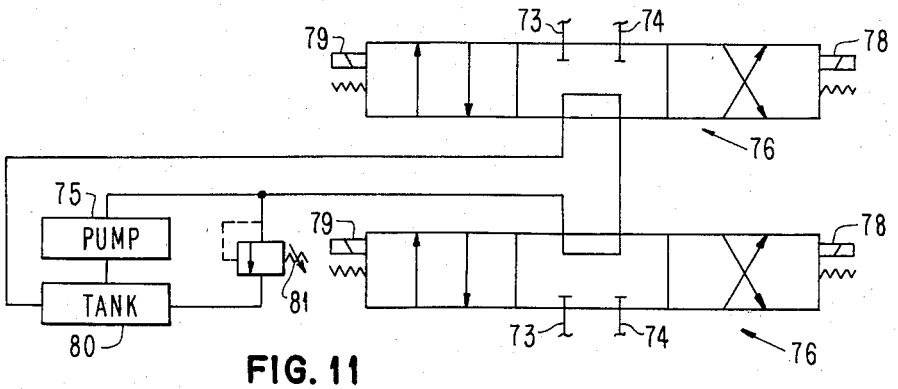
FIG. 11 is a schematic view of a hydraulic system for controlling the rotation of the drums of both of the hoists.

Hydraulic fluid is supplied to the hydraulic motor 69 through hoses 73 and 74 to control the direction of rotation of the hydraulic motor 69. The flow of hydraulic fluid to and from a hydraulic pump 75 (see FIG. 11) to the hoses 73 and 74 of the hoist hydraulic motor 69 (see FIG. 5) is controlled by the position of a directional control valve 76 (see FIG. 11). One suitable example of the directional control valve 76 for each of the hoists 41 (see FIG. 3) is a four-way, three-position tandem center hydraulic directional control valve sold as model No. 85004000 by Delta Power Hydraulic Company, Rockford, Illinois.

The position of the directional control valve 76 (see FIG. 11) is controlled through a control switch 77 (see FIG. 1), which is a single pole, double throw, center off switch. The position of the control switch 77 determines whether a solenoid 78 (see FIG. 11) or a solenoid 79 is energized or whether both of the solenoids 78 and 79 are deenergized.

When one of the solenoids 78 and 79 is energized, the pressurized hydraulic fluid flows from the pump 75 through the hose 73 to the hydraulic motor 69 (see FIG. 5) and returns to a tank 80 (see FIG. 11) through the hose 74. When the other of the solenoids 78 and 79 is energized, the pressurized fluid is supplied to the hydraulic motor 69 (see FIG. 5) through the hose 74 from the pump 75 (see FIG. 11) and returned through the hose 73 to the tank 80. When one of the solenoids 78 and 79 is energized and the hydraulic motor 69 (see FIG. 5) is prevented from rotating such as, for example, when the hoist 41 is hung against the framework of the barn, the fluid is returned to the tank 80 (see FIG. 11) through a relief valve 81. Accordingly, the position of the control switch 77 (see FIG. 1) determines whether there is flow to the hydraulic motor 69 (see FIG. 5) and the direction of flow so as to control the direction of rotation of the hydraulic motor 69.

The hydraulic pump 75 (see FIG. 11) can be driven from a gasoline engine or an electric motor, for example. Instead of using the hydraulic pump 75, the hydraulic system of a tractor could be employed. It is only necessary that the flow of hydraulic fluid through the hoses 73 and 74 be controlled by the control switches 77 (see FIG. 1).

In order to insure that each end of each of the support beams 10 (see FIG. 2) is supported by the rail supports 37 through the projecting portion 26 of each of the steel straps 20 engaging therewith, each of the rail supports 37 has a support block 85 attached to at least one side thereof to increase the width to insure that one end of each of two of the support beams 10 can be readily supported thereby. A gusset board 86 is attached to each of the rail supports 37 and to each of the support blocks 85, which are fixed to the rail supports 37.

The support beam 10 can have the tobacco sticks 11 (see FIG. 1) loaded thereon in the barn. When this occurs, the tobacco is transported to the barn by a conventional vehicle such as a wagon or truck, for example, and the sticks 11, which have the stalks of tobacco 12 thereon, manually placed in the elongated openings 19' between the upper wooden member 14 and the lower wooden member 15 with the sticks 11 being disposed on opposite sides of the support beam 10 in alternating sequence.

Figure 9:
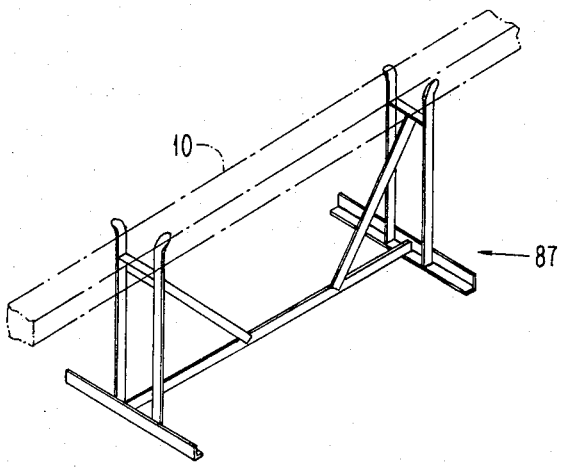
FIG. 9 is a perspective view of a support arrangement for loading tobacco on a support beam in a barn.

One means of supporting the support beam 10 to receive the tobacco sticks 11 is a stand 87 (see FIG. 9), which is preferably formed of metal. Any other suitable means for suspending the support beam 10 in a position in which it may receive the tobacco sticks 11 (see FIG. 1) with the tobacco 12 thereon may be employed. It is necessary that the stand 82 (see FIG. 9) be capable of being positioned below the cables 22 (see FIG. 1), which are to be received in the longitudinal slots 21 of the support beam 10. Of course, the metal stand 87 (see FIG. 9) is positioned prior to receiving the support beam 10.

Figure 10:
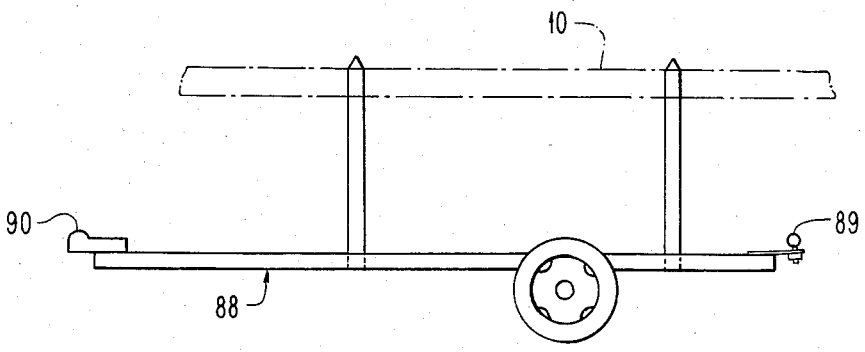
FIG. 10 is a view of a carrier for transporting a tobacco loaded support beam from a field to a barn.

Instead of transporting the tobacco stalks 12 (see FIG. 1) on the tobacco sticks 11 to the barn by a conventional vehicle and using the stand 87, a two-wheel carrier 88 (see FIG. 10) may be employed to support the support beam 10. The carrier 88 would have a hitch 89 on its rear to connect with a hitch 90 on the front of the rearward carrier 88. This would enable several of the carriers 88 to be connected to each other for transport to the barn. In this arrangement, each of the carriers 88 would have to be disposed so that the cables 22 (see FIG. 1) can be received in the longitudinal slots 21 of the support beam 10.

Considering the operation of the present invention, the support beam 10 is positioned, either on the stand 87 (see FIG. 9) or by the carrier 88 (see FIG. 10), so that the longitudinal slots 21 (see FIG. 1) in the support beam 10 receive the cables 22. The loop 38 of each of the cables 22 is attached to the hook 39 (see FIGS. 4 and 6) of the drum 40 of one of the hoist 41. Then, each of the hoists 41 is raised until the top plate 43 of the frame 42 engages with the bottom surface of the lower wooden member 15 as shown in FIG. 7. Each of the hoists 41 is disposed so that it is inside of the projecting portions 29 of the steel straps 20. Thus, the hoists 41 cannot be moved outwardly.

Then, the hydraulic motor 69 (see FIG. 4) of one of the hoists 41 is activated for a longer period of time than the other to tilt the support beam 10 (see FIG. 1) so that it may pass between the rail supports 37 on which it is to be eventually supported. After the support beam 10 has been moved above the rail support 37 on which it is to rest, the support beam 10 is leveled by controlling rotation of the drums 40 (see FIG. 7) of the hoists 41 and then lowered by rotating the drum 40 of each of the hoists 41 so that each end of the support beam 10 rests on the rail support 37 (see FIG. 2) or the block 85 in the manner shown in FIG. 2.

Each of the rail supports 37 and the attached blocks 85 beneath the uppermost of the rail supports 37 also has the support beams 10 disposed thereon in the same manner. This continues for all of the tiers in the barn.

When it is desired to remove the tobacco stalks 12 (see FIG. 1) after air curing in the barn has been completed so that the leaves may be stripped therefrom, the loop 38 of each of the cables 22 is attached to the hook 39 (see FIG. 4) on the drum 40 of one of the hoists 41. Then, the hydraulic motors 69 of the hoists 41 are actuated to have the top plate 43 on the frame 42 of each of the hoists 41 engage the bottom surface of the lower wooden member 15 (see FIG. 7) of the support beam 10 at opposite ends thereof. The support beam 10 is raised sufficiently that the projecting portions 26 on the steel straps 20 clear the gusset boards 86 (see FIG. 2).

Then, one end of the support beam 10 is raised higher than the other so that the support beam 10 can pass between the rail supports 37 and the attached blocks 85. Next, the direction of rotation of the hydraulic motor 69 (see FIG. 4) of each of the hoists 41 is reversed to lower the support beam 10 to a position in which the tobacco sticks 11 (see FIG. 1) may be removed from the support beam 10. It is not necessary to dispose the support beam 10 on the stand 87 (see FIG. 9) or the carrier 88 (see FIG. 10) at this time unless such is desired.

An advantage of this invention is that it is adaptable to a one man operation for housing of tobacco. Another advantage of this invention is that it decreases labor costs for housing tobacco. A further advantage of this invention is that it decreases the physical requirement for housing tobacco. Still another advantage of this invention is that it reduces the time to transport tobacco from the ground into the barn for housing and then from the barn to the ground for stripping after the housed tobacco has cured. A still further advantage of this invention is that it decreases the danger of injury to the worker. Yet another advantage of this invention is that any barn may be used with a minimum modification.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. An apparatus for harvesting tobacco including:

a support beam;

said support beam having means to receive tobacco sticks therein for support by said support beam;

each end of said support beam having enabling means to enable a cable extending downwardly from a barn support to pass therethrough;

separate hoist means for attachment to the lower end of each of the two cables passing through said enabling means in said support beam and engaging the bottom surface of said support beam to raise or lower said support beam along the cables passing through said enabling means;

said support beam having means adjacent each end to limit outward movement of each of said hoist means;

each of said hoist means including:

a rotatable drum;

means to support said rotatable drum for rotation relative thereto, said support means engaging the bottom surface of said support beam to raise or lower said support beam along the cables passing through said enabling means;

said rotatable drum having attachment means for attachment to the lower end of one of the cables;

and rotating means to rotate said rotatable drum in either direction to selectively wind and unwind the cable attached to said attachment means therearound, said rotating means being supported by said support means;

each end of said support beam including support means for cooperating with a support member in a barn to support said support beam;

said support means of each of said hoist means including:

means to engage the bottom surface of said support beam to be raised or lowered along the cable passing through said enabling means;

and said engaging means having passage means to allow passage of the cable therethrough for attachment to said attachment means of said rotatable drum of said hoist means;

said engaging means of said hoist means including a plate;

and said passage means of said engaging means being an opening in said plate.

2. The apparatus according to claim 1 in which each of said hoist means includes:

four legs extending downwardly from said plate, two of said legs being shorter than the other two of said legs, each of said shorter legs being substantially the same length and each of said longer legs being substantially the same length;

first means extending from the bottom end of one of said shorter legs to the bottom end of one of said longer legs and second means extending from the bottom end of the other of said shorter legs to the bottom end of the other of said longer legs.

3. An apparatus for harvesting tobacco including:

a support beam;

said support beam having means to receive tobacco sticks therein for support by said support beam;

each end of said support beam having enabling means to enable a cable extending downwardly from a barn support to pass therethrough;

separate hoist means for attachment to the lower end of each of the two cables passing through said enabling means in said support beam and engaging the bottom surface of said support beam to raise or lower said support beam along the cables passing through said enabling means;

said support beam having means adjacent each end to limit outward movement of each of said hoist means;

each of said hoist means including:

a rotatable drum;

means to support said rotatable drum for rotation relative thereto, said support means engaging the bottom surface of said support beam to raise or lower said support beam along the cables passing through said enabling means;

said rotatable drum having attachment means for attachment to the lower end of one of the cables;

and rotating means to rotate said rotatable drum in either direction to selectively wind and unwind the cable attached to said attachment means therearound, said rotating means being supported by said support means;

and said support means of each of said hoist means including:

a plate to engage the bottom surface of said support beam to be raised or lowered along the cable passing through said enabling means;

said plate having an opening to allow passage of the cable therethrough for attachment to said attachment means of said rotatable drum of said hoist means;

four legs extending downwardly from said plate, two of said legs being shorter than the other two of said legs, each of said shorter legs being substantially the same length and each of said longer legs being substantially the same length;

first means extending from the bottom end of one of said shorter legs to the bottom end of one of said longer legs;

and second means extending from the bottom end of the other of said shorter legs to the bottom end of the other of said longer legs.

4. A hoist for use in raising and lowering a support beam having tobacco sticks supported thereby with the tobacco sticks having tobacco thereon including:

frame means;

a drum rotatably supported by said frame means;

said drum having attachment means for attachment to the lower end of a cable attached in the upper end of a barn and passing through the support beam;

said frame means having means for engaging the support beam to raise and lower the support beam after said attachment means is attached to the cable passing through the support beam;

rotating means to rotate said drum in either direction, said frame means supporting said rotating means;

said frame means having its bottom end formed at an angle to clear any rail support during raising and lowering of the support beam;

said engaging means of said frame means including means to allow the cable to pass therethrough for attachment to said attachment means of said drum;

said engaging means of said frame means including a plate;

and said allowing means of said engaging means being an opening in said plate.

5. The hoist according to claim 4 in which said frame means includes:

four legs extending downwardly from said plate, two of said legs being shorter than the other two of said legs, each of said shorter legs being substantially the same length and each of said longer legs being substantially the same length;

first means extending from the bottom end of one of said shorter legs to the bottom end of one of said longer legs;

and second means extending from the bottom end of the other of said shorter legs to the bottom end of the other of said longer legs.

6. A method of harvesting tobacco including:

disposing sticks of tobacco on a support beam;

passing a first cable supported at its upper end in the upper portion of a barn through a longitudinal slot in one end of the support beam and a second cable supported at its upper end in the upper portion of a barn through a longitudinal slot in the other end of the support beam;

attaching the lower end of the first cable to a first rotary drum and the lower end of the second cable to a second rotary drum;

rotating the first rotary drum and the second rotary drum until a support for the first rotary drum engages the bottom of the support beam and a support for the second rotary drum engages the bottom of the support beam;

selectively rotating the first rotary drum and the second rotary drum to tilt one end of the support beam relative to its other end to enable the support beam to pass between barn supports on which the support beam is to rest;

changing the direction of rotation of each of the first rotary drum and the second rotary drum after the support beam is above the barn supports on which the support beam is to rest;

and selectively rotating the first rotary drum and the second rotary drum to dispose the support beam on the barn supports on which the support beam is to rest.

* * * * *

UNITED STATES PATENT AND TRADEMARK OFFICE

CERTIFICATE OF CORRECTION

PATENT NO. : 4,508,482

DATED : April 2, 1985

INVENTOR(S) : George A. Duncan

It is certified that error appears in the above-identified patent and that said Letters Patent is hereby corrected as shown below:

Column 8, line 37, "hoist" should read --- hoists ---.

Signed and Sealed this

*Tenth* Day of *September 1985*

[SEAL]

*Attest:*

DONALD J. QUIGG

*Attesting Officer* *Acting Commissioner of Patents and Trademarks - Designate*